US010134325B2

(12) United States Patent
Chaji et al.

(10) Patent No.: US 10,134,325 B2
(45) Date of Patent: Nov. 20, 2018

(54) INTEGRATED DISPLAY SYSTEM

(71) Applicant: Ignis Innovation Inc., Waterloo (CA)

(72) Inventors: Gholamreza Chaji, Waterloo (CA); Yaser Azizi, Waterloo (CA)

(73) Assignee: Ignis Innovation Inc., Waterloo (CA)

( * ) Notice: Subject to any disclaimer, the term of this patent is extended or adjusted under 35 U.S.C. 154(b) by 323 days.

(21) Appl. No.: 14/961,983

(22) Filed: Dec. 8, 2015

(65) Prior Publication Data

US 2016/0163253 A1 Jun. 9, 2016

Related U.S. Application Data

(60) Provisional application No. 62/095,339, filed on Dec. 22, 2014, provisional application No. 62/106,980, filed on Jan. 23, 2015.

(30) Foreign Application Priority Data

Dec. 8, 2014 (CA) ..... 2873476

(51) Int. Cl.

| | |
|---|---|
| ***G09G 3/20*** | (2006.01) |
| ***G09G 3/3233*** | (2016.01) |
| ***G09G 3/3258*** | (2016.01) |

(52) U.S. Cl.

CPC ..... *G09G 3/2011* (2013.01); *G09G 3/2014* (2013.01); *G09G 3/2022* (2013.01); *G09G 3/2096* (2013.01); *G09G 3/3233* (2013.01); *G09G 3/3258* (2013.01); *G09G 2300/0828* (2013.01); *G09G 2300/0857* (2013.01); *G09G 2310/0286* (2013.01); *G09G 2310/08* (2013.01); *G09G 2320/064* (2013.01); *G09G 2330/021* (2013.01); *G09G 2330/12* (2013.01); *G09G 2360/12* (2013.01)

(58) Field of Classification Search

CPC ..... G09G 3/2085; G09G 2320/064; G09G 2310/0206

See application file for complete search history.

(56) References Cited

U.S. PATENT DOCUMENTS 3,506,851 A 4/1970 Polkinghorn et al.
3,750,987 A 8/1973 Gobel
(Continued)

FOREIGN PATENT DOCUMENTS

AU 729652 6/1997
AU 764896 12/2001
(Continued)

OTHER PUBLICATIONS

Ahnood et al.: "Effect of threshold voltage instability on field effect mobility in thin film transistors deduced from constant current measurements"; dated Aug. 2009.
(Continued)

*Primary Examiner* — Priyank Shah
(74) *Attorney, Agent, or Firm* — Stratford Managers Corporation

(57) ABSTRACT

What is disclosed are systems and methods for emissive display systems constructed on integrated architecture platforms, for which the pixels are smart and can behave differently under different conditions to save power, provide better image quality, and/or conserve their value to reduce the power consumption associated with programming.

18 Claims, 9 Drawing Sheets

(56) References Cited

U.S. PATENT DOCUMENTS 3,774,055 A 11/1973 Bapat et al.
4,090,096 A 5/1978 Nagami
4,354,162 A 10/1982 Wright
4,996,523 A 2/1991 Bell et al.
5,029,105 A * 7/1991 Coleman ..... G06T 15/005 345/539
5,134,387 A 7/1992 Smith et al.
5,153,420 A 10/1992 Hack et al.
5,170,158 A 12/1992 Shinya
5,204,661 A 4/1993 Hack et al.
5,266,515 A 11/1993 Robb et al.
5,278,542 A 1/1994 Smith et al.
5,408,267 A 4/1995 Main
5,498,880 A 3/1996 Lee et al.
5,572,444 A 11/1996 Lentz et al.
5,589,847 A 12/1996 Lewis
5,619,033 A 4/1997 Weisfield
5,648,276 A 7/1997 Hara et al.
5,670,973 A 9/1997 Bassetti et al.
5,691,783 A 11/1997 Numao et al.
5,701,505 A 12/1997 Yamashita et al.
5,714,968 A 2/1998 Ikeda
5,744,824 A 4/1998 Kousai et al.
5,745,660 A 4/1998 Kolpatzik et al.
5,748,160 A 5/1998 Shieh et al.
5,758,129 A 5/1998 Gray et al.
5,835,376 A 11/1998 Smith et al.
5,870,071 A 2/1999 Kawahata
5,874,803 A 2/1999 Garbuzov et al.
5,880,582 A 3/1999 Sawada
5,903,248 A 5/1999 Irwin
5,917,280 A 6/1999 Burrows et al.
5,949,398 A 9/1999 Kim
5,952,789 A 9/1999 Stewart et al.
5,990,629 A 11/1999 Yamada et al.
6,023,259 A 2/2000 Howard et al.
6,067,065 A * 5/2000 Worley, III ..... G09G 3/3648 345/204
6,069,365 A 5/2000 Chow et al.
6,091,203 A 7/2000 Kawashima et al.
6,097,360 A 8/2000 Holloman
6,100,868 A 8/2000 Lee et al.
6,144,222 A 11/2000 Ho
6,229,506 B1 5/2001 Dawson et al.
6,229,508 B1 5/2001 Kane
6,246,180 B1 6/2001 Nishigaki
6,252,248 B1 6/2001 Sano et al.
6,268,841 B1 7/2001 Cairns et al.
6,288,696 B1 9/2001 Holloman
6,307,322 B1 10/2001 Dawson et al.
6,310,962 B1 10/2001 Chung et al.
6,323,631 B1 11/2001 Juang
6,333,729 B1 12/2001 Ha
6,384,804 B1 5/2002 Dodabalapur et al.
6,388,653 B1 5/2002 Goto et al.
6,392,617 B1 5/2002 Gleason
6,396,469 B1 5/2002 Miwa et al.
6,414,661 B1 7/2002 Shen et al.
6,417,825 B1 7/2002 Stewart et al.
6,430,496 B1 8/2002 Smith et al.
6,433,488 B1 8/2002 Bu
6,473,065 B1 10/2002 Fan
6,475,845 B2 11/2002 Kimura
6,501,098 B2 12/2002 Yamazaki
6,501,466 B1 12/2002 Yamagashi et al.
6,522,315 B2 2/2003 Ozawa et al.
6,535,185 B2 3/2003 Kim et al.
6,542,138 B1 4/2003 Shannon et al.
6,559,839 B1 5/2003 Ueno et al.
6,580,408 B1 6/2003 Bae et al.
6,583,398 B2 6/2003 Harkin
6,618,030 B2 9/2003 Kane et al.
6,639,244 B1 10/2003 Yamazaki et al.
6,680,580 B1 1/2004 Sung
6,686,699 B2 2/2004 Yumoto
6,690,000 B1 2/2004 Muramatsu et al.
6,693,610 B2 2/2004 Shannon et al.
6,694,248 B2 2/2004 Smith et al.
6,697,057 B2 2/2004 Koyama et al.
6,724,151 B2 4/2004 Yoo
6,734,636 B2 5/2004 Sanford et al.
6,753,655 B2 6/2004 Shih et al.
6,753,834 B2 6/2004 Mikami et al.
6,756,741 B2 6/2004 Li
6,756,958 B2 6/2004 Furuhashi et al.
6,777,888 B2 8/2004 Kondo
6,781,567 B2 8/2004 Kimura
6,788,231 B1 9/2004 Hsueh
6,809,706 B2 10/2004 Shimoda
6,828,950 B2 12/2004 Koyama
6,858,991 B2 2/2005 Miyazawa
6,859,193 B1 2/2005 Yumoto
6,876,346 B2 4/2005 Anzai et al.
6,900,485 B2 5/2005 Lee
6,903,734 B2 6/2005 Eu
6,911,960 B1 6/2005 Yokoyama
6,911,964 B2 6/2005 Lee et al.
6,914,448 B2 7/2005 Jinno
6,919,871 B2 7/2005 Kwon
6,924,602 B2 8/2005 Komiya
6,937,220 B2 8/2005 Kitaura et al.
6,940,214 B1 9/2005 Komiya et al.
6,954,194 B2 10/2005 Matsumoto et al.
6,970,149 B2 11/2005 Chung et al.
6,975,142 B2 12/2005 Azami et al.
6,975,332 B2 12/2005 Arnold et al.
6,995,519 B2 2/2006 Arnold et al.
7,027,015 B2 4/2006 Booth, Jr. et al.
7,034,793 B2 4/2006 Sekiya et al.
7,038,392 B2 5/2006 Libsch et al.
7,057,588 B2 6/2006 Asano et al.
7,061,451 B2 6/2006 Kimura
7,071,932 B2 7/2006 Libsch et al.
7,106,285 B2 9/2006 Naugler
7,112,820 B2 9/2006 Chang et al.
7,113,864 B2 9/2006 Smith et al.
7,122,835 B1 10/2006 Ikeda et al.
7,129,914 B2 10/2006 Knapp et al.
7,164,417 B2 1/2007 Cok
7,224,332 B2 5/2007 Cok
7,248,236 B2 7/2007 Nathan et al.
7,259,737 B2 8/2007 Ono et al.
7,262,753 B2 8/2007 Tanghe et al.
7,274,363 B2 9/2007 Ishizuka et al.
7,310,092 B2 12/2007 Imamura
7,315,295 B2 1/2008 Kimura
7,317,434 B2 1/2008 Lan et al.
7,321,348 B2 1/2008 Cok et al.
7,327,357 B2 2/2008 Jeong
7,333,077 B2 2/2008 Koyama et al.
7,343,243 B2 3/2008 Smith et al.
7,414,600 B2 8/2008 Nathan et al.
7,466,166 B2 12/2008 Date et al.
7,495,501 B2 2/2009 Iwabuchi et al.
7,502,000 B2 3/2009 Yuki et al.
7,515,124 B2 4/2009 Yaguma et al.
7,535,449 B2 5/2009 Miyazawa
7,554,512 B2 6/2009 Steer
7,569,849 B2 8/2009 Nathan et al.
7,595,776 B2 9/2009 Hashimoto et al.
7,604,718 B2 10/2009 Zhang et al.
7,609,239 B2 10/2009 Chang
7,612,745 B2 11/2009 Yumoto et al.
7,619,594 B2 11/2009 Hu
7,619,597 B2 11/2009 Nathan et al.
7,639,211 B2 12/2009 Miyazawa
7,683,899 B2 3/2010 Hirakata et al.
7,688,289 B2 3/2010 Abe et al.
7,760,162 B2 7/2010 Miyazawa
7,808,008 B2 10/2010 Miyake
7,859,520 B2 12/2010 Kimura
7,889,159 B2 2/2011 Nathan et al.
7,903,127 B2 3/2011 Kwon
7,920,116 B2 4/2011 Woo et al.

(56) References Cited

U.S. PATENT DOCUMENTS 7,944,414 B2 5/2011 Shirasaki et al.
7,978,170 B2 7/2011 Park et al.
7,989,392 B2 8/2011 Crockett et al.
7,995,008 B2 8/2011 Miwa
8,063,852 B2 11/2011 Kwak et al.
8,102,343 B2 1/2012 Yatabe
8,144,081 B2 3/2012 Miyazawa
8,159,007 B2 4/2012 Bama et al.
8,242,979 B2 8/2012 Anzai et al.
8,253,665 B2 8/2012 Nathan et al.
8,283,967 B2 10/2012 Chaji et al.
8,319,712 B2 11/2012 Nathan et al.
8,564,513 B2 10/2013 Nathan et al.
8,872,739 B2 10/2014 Kimura
2001/0002703 A1 6/2001 Koyama
2001/0009283 A1 7/2001 Arao et al.
2001/0024186 A1 9/2001 Kane et al.
2001/0026257 A1 10/2001 Kimura
2001/0030323 A1 10/2001 Ikeda
2001/0035863 A1 11/2001 Kimura
2001/0040541 A1 11/2001 Yoneda et al.
2001/0043173 A1 11/2001 Troutman
2001/0045929 A1 11/2001 Prache
2001/0052940 A1 12/2001 Hagihara et al.
2002/0000576 A1 1/2002 Inukai
2002/0011796 A1 1/2002 Koyama
2002/0011799 A1 1/2002 Kimura
2002/0012057 A1 1/2002 Kimura
2002/0030190 A1 3/2002 Ohtani et al.
2002/0047565 A1 4/2002 Nara et al.
2002/0052086 A1 5/2002 Maeda
2002/0080108 A1 6/2002 Wang
2002/0084463 A1 7/2002 Sanford et al.
2002/0101172 A1 8/2002 Bu
2002/0117722 A1 8/2002 Osada et al.
2002/0140712 A1 10/2002 Ouchi et al.
2002/0158587 A1 10/2002 Komiya
2002/0158666 A1 10/2002 Azami et al.
2002/0158823 A1 10/2002 Zavracky et al.
2002/0171613 A1 11/2002 Goto et al.
2002/0181275 A1 12/2002 Yamazaki
2002/0186214 A1 12/2002 Siwinski
2002/0190971 A1 12/2002 Nakamura et al.
2002/0195967 A1 12/2002 Kim et al.
2002/0195968 A1 12/2002 Sanford et al.
2002/0196213 A1 12/2002 Akimoto et al.
2003/0001828 A1 1/2003 Asano
2003/0001858 A1 1/2003 Jack
2003/0016190 A1 1/2003 Kondo
2003/0020413 A1 1/2003 Oomura
2003/0030603 A1 2/2003 Shimoda
2003/0062524 A1 4/2003 Kimura
2003/0062844 A1 4/2003 Miyazawa
2003/0076048 A1 4/2003 Rutherford
2003/0090445 A1 5/2003 Chen et al.
2003/0090447 A1 5/2003 Kimura
2003/0090481 A1 5/2003 Kimura
2003/0095087 A1 5/2003 Libsch
2003/0098829 A1 5/2003 Chen et al.
2003/0107560 A1 6/2003 Yumoto et al.
2003/0107561 A1 6/2003 Uchino et al.
2003/0111966 A1 6/2003 Mikami et al.
2003/0112205 A1 6/2003 Yamada
2003/0112208 A1 6/2003 Okabe et al.
2003/0117348 A1 6/2003 Knapp et al.
2003/0122474 A1 7/2003 Lee
2003/0122747 A1 7/2003 Shannon et al.
2003/0128199 A1 7/2003 Kimura
2003/0151569 A1 8/2003 Lee et al.
2003/0156104 A1 8/2003 Morita
2003/0169241 A1 9/2003 LeChevalier
2003/0169247 A1 9/2003 Kawabe et al.
2003/0174152 A1 9/2003 Noguchi
2003/0179626 A1 9/2003 Sanford et al.
2003/0185438 A1 10/2003 Osawa et al.
2003/0189535 A1 10/2003 Matsumoto et al.
2003/0197663 A1 10/2003 Lee et al.
2003/0214465 A1 11/2003 Kimura
2003/0227262 A1 12/2003 Kwon
2003/0230141 A1 12/2003 Gilmour et al.
2003/0230980 A1 12/2003 Forrest et al.
2004/0004589 A1 1/2004 Shih
2004/0032382 A1 2/2004 Cok et al.
2004/0041750 A1 3/2004 Abe
2004/0066357 A1 4/2004 Kawasaki
2004/0070557 A1 4/2004 Asano et al.
2004/0070558 A1 4/2004 Cok
2004/0090186 A1 5/2004 Yoshida et al.
2004/0095338 A1 5/2004 Takashi
2004/0129933 A1 7/2004 Nathan et al.
2004/0130516 A1 7/2004 Nathan et al.
2004/0135749 A1 7/2004 Kondakov et al.
2004/0145547 A1 7/2004 Oh
2004/0150595 A1 8/2004 Kasai
2004/0155841 A1 8/2004 Kasai
2004/0171619 A1 9/2004 Barkoczy et al.
2004/0174349 A1 9/2004 Libsch
2004/0174354 A1 9/2004 Ono
2004/0183759 A1 9/2004 Stevenson et al.
2004/0189627 A1 9/2004 Shirasaki et al.
2004/0196275 A1 10/2004 Hattori
2004/0227697 A1 11/2004 Mori
2004/0239696 A1 12/2004 Okabe
2004/0251844 A1 12/2004 Hashido et al.
2004/0252085 A1 12/2004 Miyagawa
2004/0252089 A1 12/2004 Ono et al.
2004/0256617 A1 12/2004 Yamada et al.
2004/0257353 A1 12/2004 Imamura et al.
2004/0257355 A1 12/2004 Naugler
2004/0263437 A1 12/2004 Hattori
2005/0007357 A1 1/2005 Yamashita et al.
2005/0052379 A1 3/2005 Waterman
2005/0057459 A1 3/2005 Miyazawa
2005/0067970 A1 3/2005 Libsch et al.
2005/0067971 A1 3/2005 Kane
2005/0083270 A1 4/2005 Miyazawa
2005/0110420 A1 5/2005 Arnold et al.
2005/0110727 A1 5/2005 Shin
2005/0123193 A1 6/2005 Lamberg et al.
2005/0140600 A1 6/2005 Kim et al.
2005/0140610 A1 6/2005 Smith et al.
2005/0145891 A1 7/2005 Abe
2005/0156831 A1 7/2005 Yamazaki et al.
2005/0168416 A1 8/2005 Hashimoto et al.
2005/0206590 A1 9/2005 Sasaki et al.
2005/0212787 A1 9/2005 Noguchi et al.
2005/0219188 A1 10/2005 Kawabe et al.
2005/0243037 A1 11/2005 Eom et al.
2005/0248515 A1 11/2005 Naugler et al.
2005/0258867 A1 11/2005 Miyazawa
2005/0285822 A1 12/2005 Reddy et al.
2005/0285825 A1 12/2005 Eom et al.
2006/0012311 A1 1/2006 Ogawa
2006/0022305 A1 2/2006 Yamashita
2006/0038750 A1 2/2006 Inoue et al.
2006/0038758 A1 2/2006 Routley et al.
2006/0038762 A1 2/2006 Chou
2006/0066533 A1 3/2006 Sato et al.
2006/0077077 A1 4/2006 Kwon
2006/0077134 A1 4/2006 Hector
2006/0077194 A1 4/2006 Jeong
2006/0092185 A1 5/2006 Jo et al.
2006/0114196 A1 6/2006 Shin
2006/0125408 A1 6/2006 Nathan et al.
2006/0125740 A1 6/2006 Shirasaki et al.
2006/0139253 A1 6/2006 Choi et al.
2006/0145964 A1 7/2006 Park et al.
2006/0158402 A1 7/2006 Nathan
2006/0191178 A1 8/2006 Sempel et al.
2006/0208971 A1 9/2006 Deane
2006/0209012 A1 9/2006 Hagood, IV
2006/0214888 A1 9/2006 Schneider et al.
2006/0221009 A1 10/2006 Miwa
2006/0227082 A1 10/2006 Ogata et al.

(56) References Cited

U.S. PATENT DOCUMENTS

2006/0232522 A1 10/2006 Roy et al.
2006/0244391 A1 11/2006 Shishido et al.
2006/0244697 A1 11/2006 Lee et al.
2006/0261841 A1 11/2006 Fish
2006/0279478 A1 12/2006 Ikegami
2006/0290614 A1 12/2006 Nathan et al.
2007/0001939 A1 1/2007 Hashimoto et al.
2007/0001945 A1 1/2007 Yoshida et al.
2007/0008251 A1 1/2007 Kohno et al.
2007/0008297 A1 1/2007 Bassetti
2007/0035489 A1 2/2007 Lee
2007/0035707 A1 2/2007 Margulis
2007/0040773 A1 2/2007 Lee et al.
2007/0040782 A1 2/2007 Woo et al.
2007/0057873 A1 3/2007 Uchino et al.
2007/0057874 A1 3/2007 Le Roy et al.
2007/0063932 A1 3/2007 Nathan et al.
2007/0075957 A1 4/2007 Chen
2007/0080908 A1 4/2007 Nathan et al.
2007/0085801 A1 4/2007 Park et al.
2007/0109232 A1 5/2007 Yamamoto et al.
2007/0128583 A1 6/2007 Miyazawa
2007/0164941 A1 7/2007 Park et al.
2007/0182671 A1 8/2007 Nathan et al.
2007/0236430 A1 10/2007 Fish
2007/0236440 A1 10/2007 Wacyk et al.
2007/0241999 A1 10/2007 Lin
2007/0242008 A1 10/2007 Cummings
2008/0001544 A1 1/2008 Murakami et al.
2008/0043044 A1 2/2008 Woo et al.
2008/0048951 A1 2/2008 Naugler et al.
2008/0055134 A1 3/2008 Li et al.
2008/0062106 A1 3/2008 Tseng
2008/0062158 A1* 3/2008 Willis ..... G09G 3/3622 345/204
2008/0088549 A1 4/2008 Nathan et al.
2008/0094426 A1 4/2008 Kimpe
2008/0111766 A1 5/2008 Uchino et al.
2008/0122819 A1 5/2008 Cho et al.
2008/0074360 A1 6/2008 Lu et al.
2008/0129906 A1 6/2008 Lin et al.
2008/0198103 A1 8/2008 Toyomura et al.
2008/0219232 A1 9/2008 Heubel et al.
2008/0228562 A1 9/2008 Smith et al.
2008/0231625 A1 9/2008 Minami et al.
2008/0231641 A1 9/2008 Miyashita
2008/0265786 A1 10/2008 Koyama
2008/0290805 A1 11/2008 Yamada et al.
2009/0009459 A1 1/2009 Miyashita
2009/0015532 A1 1/2009 Katayama et al.
2009/0058789 A1 3/2009 Hung et al.
2009/0091579 A1* 4/2009 Teranishi ..... G09G 3/3659 345/530
2009/0121988 A1 5/2009 Amo et al.
2009/0146926 A1 6/2009 Sung et al.
2009/0153448 A1 6/2009 Tomida et al.
2009/0153459 A9 6/2009 Han et al.
2009/0174628 A1 7/2009 Wang et al.
2009/0201230 A1 8/2009 Smith
2009/0201281 A1 8/2009 Routley et al.
2009/0206764 A1 8/2009 Schemmann et al.
2009/0225011 A1 9/2009 Choi
2009/0244046 A1 10/2009 Seto
2009/0251486 A1 10/2009 Sakakibara et al.
2009/0278777 A1 11/2009 Wang et al.
2009/0289964 A1 11/2009 Miyachi
2009/0295423 A1 12/2009 Levey
2010/0026725 A1 2/2010 Smith
2010/0033469 A1 2/2010 Nathan
2010/0039451 A1 2/2010 Jung
2010/0039453 A1 2/2010 Nathan et al.
2010/0045646 A1 2/2010 Kishi
2010/0052964 A1* 3/2010 Lee ..... G09G 3/3688 341/144
2010/0079419 A1 4/2010 Shibusawa
2010/0134475 A1 6/2010 Ogura
2010/0141564 A1 6/2010 Choi et al.
2010/0207920 A1 8/2010 Chaji et al.
2010/0225634 A1 9/2010 Levey et al.
2010/0251295 A1 9/2010 Amento et al.
2010/0265224 A1* 10/2010 Cok ..... G09G 3/3266 345/206
2010/0269889 A1 10/2010 Reinhold et al.
2010/0277400 A1 11/2010 Jeong
2010/0315319 A1 12/2010 Cok et al.
2010/0315449 A1 12/2010 Chaji
2011/0043541 A1* 2/2011 Cok ..... G09G 3/006 345/690
2011/0050741 A1 3/2011 Jeong
2011/0063197 A1 3/2011 Chung et al.
2011/0069089 A1 3/2011 Kopf et al.
2011/0074762 A1 3/2011 Shirasaki
2011/0084993 A1 4/2011 Kawabe
2011/0109350 A1 5/2011 Chaji et al.
2011/0169805 A1 7/2011 Katsunori
2011/0191042 A1 8/2011 Chaji
2011/0205221 A1 8/2011 Lin
2012/0026146 A1 2/2012 Kim
2012/0038597 A1* 2/2012 Coulson ..... G09G 3/3659 345/204
2012/0169793 A1 7/2012 Nathan
2012/0299976 A1 11/2012 Chen et al.
2012/0299978 A1 11/2012 Chaji
2013/0082912 A1* 4/2013 Smith ..... H04N 13/0438 345/82
2014/0267215 A1 9/2014 Soni
2015/0062204 A1* 3/2015 Takanohashi ..... G09G 3/3208 345/694
2015/0371591 A1* 12/2015 Suzuki ..... G09G 3/32 345/208
2017/0330508 A1* 11/2017 Saito ..... G09G 3/3225

FOREIGN PATENT DOCUMENTS

CA 1 294 034 1/1992
CA 2 249 592 7/1998
CA 2 303 302 3/1999
CA 2 368 386 9/1999
CA 2 242 720 1/2000
CA 2 354 018 6/2000
CA 2 432 530 7/2002
CA 2 436 451 8/2002
CA 2 507 276 8/2002
CA 2 463 653 1/2004
CA 2 498 136 3/2004
CA 2 522 396 11/2004
CA 2 438 363 2/2005
CA 2 443 206 3/2005
CA 2 519 097 3/2005
CA 2 472 671 12/2005
CA 2 523 841 1/2006
CA 2 567 076 1/2006
CA 2 495 726 7/2006
CA 2 557 713 11/2006
CA 2 526 782 C 8/2007
CA 2 651 893 11/2007
CA 2 672 590 10/2009
CN 1601594 A 3/2005
CN 1886774 12/2006
CN 101395653 3/2009
DE 202006007613 9/2006
EP 0 478 186 4/1992
EP 1 028 471 A 8/2000
EP 1 130 565 A1 9/2001
EP 1 194 013 4/2002
EP 1 321 922 6/2003
EP 1 335 430 A1 8/2003
EP 1 381 019 1/2004
EP 1 429 312 A 6/2004
EP 1 439 520 A2 7/2004
EP 1 465 143 A 10/2004
EP 1 473 689 A 11/2004
EP 1 517 290 A2 3/2005

(56) References Cited

FOREIGN PATENT DOCUMENTS

| | | | |
|---|---|---|---|
| EP | 1 521 203 | A2 | 4/2005 |
| GB | 2 399 935 | | 9/2004 |
| GB | 2 460 018 | | 11/2009 |
| JP | 09 090405 | | 4/1997 |
| JP | 10-254410 | | 9/1998 |
| JP | 11 231805 | | 8/1999 |
| JP | 2002-278513 | | 9/2002 |
| JP | 2003-076331 | | 3/2003 |
| JP | 2003-099000 | | 4/2003 |
| JP | 2003-173165 | | 6/2003 |
| JP | 2003-186439 | | 7/2003 |
| JP | 2003-195809 | | 7/2003 |
| JP | 2003-271095 | | 9/2003 |
| JP | 2003-308046 | | 10/2003 |
| JP | 2004-054188 | | 2/2004 |
| JP | 2004-226960 | | 8/2004 |
| JP | 2005-004147 | | 1/2005 |
| JP | 2005-099715 | | 4/2005 |
| JP | 2005-258326 | | 9/2005 |
| JP | 2005-338819 | | 12/2005 |
| TW | 569173 | | 1/2004 |
| TW | 200526065 | | 8/2005 |
| TW | 1239501 | | 9/2005 |
| WO | WO 98/11554 | | 3/1998 |
| WO | WO 99/48079 | | 9/1999 |
| WO | WO 01/27910 | A1 | 4/2001 |
| WO | WO 02/067327 | A | 8/2002 |
| WO | WO 03/034389 | | 4/2003 |
| WO | WO 03/063124 | | 7/2003 |
| WO | WO 03/075256 | | 9/2003 |
| WO | WO 2004/003877 | | 1/2004 |
| WO | WO 2004/015668 | A1 | 2/2004 |
| WO | WO 2004/034364 | | 4/2004 |
| WO | WO 2005/022498 | | 3/2005 |
| WO | WO 2005/055185 | | 6/2005 |
| WO | WO 2005/055186 | A1 | 6/2005 |
| WO | WO 2005/069267 | | 7/2005 |
| WO | WO 2005/122121 | | 12/2005 |
| WO | WO 2006/063448 | | 6/2006 |
| WO | WO 2006/128069 | | 11/2006 |
| WO | WO 2007/079572 | | 7/2007 |
| WO | WO 2008/057369 | | 5/2008 |
| WO | WO 2008/0290805 | | 11/2008 |
| WO | WO 2009/059028 | | 5/2009 |
| WO | WO 2009/127065 | | 10/2009 |
| WO | WO 2010/066030 | | 6/2010 |
| WO | WO 2010/120733 | | 10/2010 |

OTHER PUBLICATIONS

Alexander et al.: "Pixel circuits and drive schemes for glass and elastic AMOLED displays"; dated Jul. 2005 (9 pages).
Alexander et al.: "Unique Electrical Measurement Technology for Compensation Inspection and Process Diagnostics of AMOLED HDTV"; dated May 2010 (4 pages).
Ashtiani et al.: "AMOLED Pixel Circuit With Electronic Compensation of Luminance Degradation"; dated Mar. 2007 (4 pages).
Chaji et al.: "A Current-Mode Comparator for Digital Calibration of Amorphous Silicon AMOLED Displays"; dated Jul. 2008 (5 pages).
Chaji et al.: "A fast settling current driver based on the CCII for AMOLED displays"; dated Dec. 2009 (6 pages).
Chaji et al.: "A Low-Cost Stable Amorphous Silicon AMOLED Display with Full V~T- and V~O~L~E~D Shift Compensation"; dated May 2007 (4 pages).
Chaji et al.: "A low-power driving scheme for a-Si:H active-matrix organic light-emitting diode displays"; dated Jun. 2005 (4 pages).
Chaji et al.: "A low-power high-performance digital circuit for deep submicron technologies"; dated Jun. 2005 (4 pages).
Chaji et al.: "A novel a-Si:H AMOLED pixel circuit based on short-term stress stability of a-Si:H TFTs"; dated Oct. 2005 (3 pages).
Chaji et al.: "A Novel Driving Scheme and Pixel Circuit for AMOLED Displays"; dated Jun. 2006 (4 pages).
Chaji et al.: "A novel driving scheme for high-resolution large-area a-Si:H AMOLED displays"; dated Aug. 2005 (4 pages).
Chaji et al.: "A Stable Voltage-Programmed Pixel Circuit for a-Si:H AMOLED Displays"; dated Dec. 2006 (12 pages).
Chaji et al.: "A Sub-μA fast-settling current-programmed pixel circuit for AMOLED displays"; dated Sep. 2007.
Chaji et al.: "An Enhanced and Simplified Optical Feedback Pixel Circuit for AMOLED Displays"; dated Oct. 2006.
Chaji et al.: "Compensation technique for DC and transient instability of thin film transistor circuits for large-area devices"; dated Aug. 2008.
Chaji et al.: "Driving scheme for stable operation of 2-TFT a-Si AMOLED pixel"; dated Apr. 2005 (2 pages).
Chaji et al.: "Dynamic-effect compensating technique for stable a-Si:H AMOLED displays"; dated Aug. 2005 (4 pages).
Chaji et al.: "Electrical Compensation of OLED Luminance Degradation"; dated Dec. 2007 (3 pages).
Chaji et al.: "eUTDSP: a design study of a new VLIW-based DSP architecture"; dated May 2003 (4 pages).
Chaji et al.: "Fast and Offset-Leakage Insensitive Current-Mode Line Driver for Active Matrix Displays and Sensors"; dated Feb. 2009 (8 pages).
Chaji et al.: "High Speed Low Power Adder Design With a New Logic Style: Pseudo Dynamic Logic (SDL)"; dated Oct. 2001 (4 pages).
Chaji et al.: "High-precision fast current source for large-area current-programmed a-Si flat panels"; dated Sep. 2006 (4 pages).
Chaji et al.: "Low-Cost AMOLED Television with IGNIS Compensating Technology"; dated May 2008 (4 pages).
Chaji et al.: "Low-Cost Stable a-Si:H AMOLED Display for Portable Applications"; dated Jun. 2006 (4 pages).
Chaji et al.: "Low-Power Low-Cost Voltage-Programmed a-Si:H AMOLED Display"; dated Jun. 2008 (5 pages).
Chaji et al.: "Merged phototransistor pixel with enhanced near infrared response and flicker noise reduction for biomolecular imaging"; dated Nov. 2008 (3 pages).
Chaji et al.: "Parallel Addressing Scheme for Voltage-Programmed Active-Matrix OLED Displays"; dated May 2007 (6 pages).
Chaji et al.: "Pseudo dynamic logic (SDL): a high-speed and low-power dynamic logic family"; dated 2002 (4 pages).
Chaji et al.: "Stable a-Si:H circuits based on short-term stress stability of amorphous silicon thin film transistors"; dated May 2006 (4 pages).
Chaji et al.: "Stable Pixel Circuit for Small-Area High-Resolution a-Si:H AMOLED Displays"; dated Oct. 2008 (6 pages).
Chaji et al.: "Stable RGBW AMOLED display with OLED degradation compensation using electrical feedback"; dated Feb. 2010 (2 pages).
Chaji et al.: "Thin-Film Transistor Integration for Biomedical Imaging and AMOLED Displays"; dated May 2008 (177 pages).
Chapter 3: Color Spaces"Keith Jack: "Video Demystified:" A Handbook for the Digital Engineer" 2001 Referex ORD-0000-00-00 USA EP040425529 ISBN: 1-878707-56-6 pp. 32-33.
Chapter 8: Alternative Flat Panel Display 1-25 Technologies; Willem den Boer: "Active Matrix Liquid Crystal Display: Fundamentals and Applications" 2005 Referex ORD-0000-00-00 U.K.; XP040426102 ISBN: 0-7506-7813-5 pp. 206-209 p. 208.
European Partial Search Report Application No. 12 15 6251.6 European Patent Office dated May 30, 2012 (7 pages).
European Patent Office Communication Application No. 05 82 1114 dated Jan. 11, 2013 (9 pages).
European Patent Office Communication with Supplemental European Search Report for EP Application No. 07 70 1644.2 dated Aug. 18, 2009 (12 pages).
European Search Report Application No. 10 83 4294.0-1903 dated Apr. 8, 2013 (9 pages).
European Search Report Application No. EP 05 80 7905 dated Apr. 2, 2009 (5 pages).
European Search Report Application No. EP 05 82 1114 dated Mar. 27, 2009 (2 pages).
European Search Report Application No. EP 07 70 1644 dated Aug. 5, 2009.

(56) References Cited

OTHER PUBLICATIONS

European Search Report Application No. EP 10 17 5764 dated Oct. 18, 2010 (2 pages).
European Search Report Application No. EP 10 82 9593.2 European Patent Office dated May 17, 2013 (7 pages).
European Search Report Application No. EP 12 15 6251.6 European Patent Office dated Oct. 12, 2012 (18 pages).
European Search Report Application No. EP. 11 175 225.9 dated Nov. 4, 2011 (9 pages).
European Supplementary Search Report Application No. EP 09 80 2309 dated May 8, 2011 (14 pages).
European Supplementary Search Report Application No. EP 09 83 1339.8 dated Mar. 26, 2012 (11 pages).
Extended European Search Report Application No. EP 06 75 2777.0 dated Dec. 6, 2010 (21 pages).
Extended European Search Report Application No. EP 09 73 2338.0 dated May 24, 2011 (8 pages).
Extended European Search Report Application No. EP 11 17 5223, 4 mailed Nov. 8, 2011 (8 pages).
Extended European Search Report Application No. EP 12 17 4465.0 European Patent Office dated Sep. 7, 2012 (9 pages).
Fan et al. "LTPS_TFT Pixel Circuit Compensation for TFT Threshold Voltage Shift and IR-Drop on the Power Line for Amolded Displays" 5 pages copyright 2012.
Goh et al. "A New a-Si:H Thin-Film Transistor Pixel Circuit for Active-Matrix Organic Light-Emitting Diodes" IEEE Electron Device Letters vol. 24 No. 9 Sep. 2003 pp. 583-585.
International Search Report Application No. PCT/CA2005/001844 dated Mar. 28, 2006 (2 pages).
International Search Report Application No. PCT/CA2006/000941 dated Oct. 3, 2006 (2 pages).
International Search Report Application No. PCT/CA2007/000013 dated May 7, 2007.
International Search Report Application No. PCT/CA2009/001049 dated Dec. 7, 2009 (4 pages).
International Search Report Application No. PCT/CA2009/001769 dated Apr. 8, 2010.
International Search Report Application No. PCT/IB2010/002898 Canadian Intellectual Property Office dated Jul. 28, 2009 (5 pages).
International Search Report Application No. PCT/IB2010/055481 dated Apr. 7, 2011 (3 pages).
International Search Report Application No. PCT/IB2011/051103 dated Jul. 8, 2011 3 pages.
International Search Report Application No. PCT/IB2012/052651 5 pages dated Sep. 11, 2012.
International Searching Authority Written Opinion Application No. PCT/IB2010/055481 dated Apr. 7, 2011 (6 pages ).
International Searching Authority Written Opinion Application No. PCT/IB2012/052651 6 pages dated Sep. 11, 2012.
International Searching Authority Written Opinion Application No. PCT/IB2011/051103 dated Jul. 8, 2011 6 pages.
International Searching Authority Written Opinion Application No. PCT/IB2010/002898 Canadian Intellectual Property Office dated Mar. 30, 2011 (8 pages).
International Searching Authority Written Opinion Application No. PCT/CA2009/001769 dated Apr. 8, 2010 (8 pages).
Jafarabadiashtiani et al.: "A New Driving Method for a-Si AMOLED Displays Based on Voltage Feedback"; dated May 2005 (4 pages).
Lee et al.: "Ambipolar Thin-Film Transistors Fabricated by PECVD Nanocrystalline Silicon"; dated May 2006 (6 pages).
Ma e y et al: "Organic Light-Emitting Diode/Thin Film Transistor Integration for foldable Displays" Conference record of the 1997 International display research conference and international workshops on LCD technology and emissive technology. Toronto Sep. 15-19, 1997 (6 pages).
Matsueda y et al.: "35.1: 2.5-in. AMOLED with Integrated 6-bit Gamma Compensated Digital Data Driver"; dated May 2004 (4 pages).
Nathan et al. "Amorphous Silicon Thin Film Transistor Circuit Integration for Organic LED Displays on Glass and Plastic" IEEE Journal of Solid-State Circuits vol. 39 No. 9 Sep. 2004 pp. 1477-1486.
Nathan et al.: "Backplane Requirements for Active Matrix Organic Light Emitting Diode Displays"; dated Sep. 2006 (16 pages).
Nathan et al.: "Call for papers second international workshop on compact thin-film transistor (TFT) modeling for circuit simulation"; dated Sep. 2009 (1 page).
Nathan et al.: "Driving schemes for a-Si and LTPS AMOLED displays"; dated Dec. 2005 (11 pages).
Nathan et al.: "Invited Paper: a-Si for AMOLED—Meeting the Performance and Cost Demands of Display Applications (Cell Phone to HDTV)"; dated Jun. 2006 (4 pages).
Nathan et al.: "Thin film imaging technology on glass and plastic"; dated Oct. 31-Nov. 2, 2000 (4 pages).
Ono et al. "Shared Pixel Compensation Circuit for AM-OLED Displays" Proceedings of the 9$^{th}$ Asian Symposium on Information Display (ASID) pp. 462-465 New Delhi dated Oct. 8-12, 2006 (4 pages).
Philipp: "Charge transfer sensing" Sensor Review vol. 19 No. 2 Dec. 31, 1999 (Dec. 31, 1999) 10 pages.
Rafati et al.: "Comparison of a 17 b multiplier in Dual-rail domino and in Dual-rail D L (D L) logic styles"; dated 2002 (4 pages).
Safavaian et al.: "Three-TFT image sensor for real-time digital X-ray imaging"; dated Feb. 2, 2006 (2 pages).
Safavian et al.: "3-TFT active pixel sensor with correlated double sampling readout circuit for real-time medical x-ray imaging"; dated Jun. 2006 (4 pages).
Safavian et al.: "A novel current scaling active pixel sensor with correlated double sampling readout circuit for real time medical x-ray imaging"; dated May 2007 (7 pages).
Safavian et al.: "A novel hybrid active-passive pixel with correlated double sampling CMOS readout circuit for medical x-ray imaging"; dated May 2008 (4 pages).
Safavian et al.: "Self-compensated a-Si:H detector with current-mode readout circuit for digital X-ray fluoroscopy"; dated Aug. 2005 (4 pages).
Safavian et al.: "TFT active image sensor with current-mode readout circuit for digital x-ray fluoroscopy [5969D-82]"; dated Sep. 2005 (9 pages).
Smith, Lindsay I., "A tutorial on Principal Components Analysis," dated Feb. 26, 2001 (27 pages).
Stewart M. et al. "Polysilicon TFT technology for active matrix OLED displays" IEEE transactions on electron devices vol. 48 No. 5 May 2001 (7 pages).
Vygranenko et al.: "Stability of indium-oxide thin-film transistors by reactive ion beam assisted deposition"; dated Feb. 2009.
Wang et al.: "Indium oxides by reactive ion beam assisted evaporation: From material study to device application," dated Mar. 2009 (6 pages).
Yi He et al. "Current-Source a-Si:H Thin Film Transistor Circuit for Active-Matrix Organic Light-Emitting Displays" IEEE Electron Device Letters vol. 21 No. 12 Dec. 2000 pp. 590-592.
International Search Report Application No. PCT/IB2013/059074, dated Dec. 18, 2013 (5 pages).
International Searching Authority Written Opinion Application No. PCT/IB2013/059074, dated Dec. 18, 2013 (8 pages ).
Extended European Search Report Application No. EP 15173106.4 dated Oct. 15, 2013 (8 pages).

* cited by examiner

INTEGRATED DISPLAY SYSTEM

CROSS REFERENCE TO RELATED APPLICATION

This application claims priority to U.S. Provisional Application No. 62/106,980, filed Jan. 23, 2015, U.S. Provisional Application No. 62/095,339, filed Dec. 22, 2014, and Canadian Application No. 2,873,476, filed Dec. 8, 2014, each of which are hereby incorporated by reference herein in its entirety.

FIELD OF THE INVENTION

This invention relates to techniques for emissive display systems constructed on integrated architecture platforms.

BRIEF SUMMARY

According to a first aspect there is provided a display system comprising: a plurality of pixels each capable of at least a first mode of operation and a second mode of operation, each pixel comprising: a digital memory for storing data comprising greyscale data for display by the pixel; and a controller operative to allow storage of incoming data to the digital memory in the first mode of operation and to preserve data in the digital memory in the second mode of operation.

In some embodiments, the plurality of pixels are arranged into at least one row, wherein each digital memory comprises a shift register, and wherein a plurality of shift registers of pixels in the at least one row are chained together into a shift register chain, wherein incoming data loaded to the shift register chain includes only data for pixels in the first mode of operation, and wherein controllers of pixels in the second mode of operation cause the incoming data to bypass the pixels in the second mode of operation.

In some embodiments, each pixel comprises a light-emitting device and a light-emitting device driver, wherein during a time of a frame the light-emitting device driver drives the light-emitting device for a total time determined by the data in the digital memory of the pixel.

In some embodiments, during a frame, the light-emitting device driver of each pixel drives the light-emitting device of the pixel in one state prior to a counter equaling a greyscale value corresponding to the greyscale data stored in the digital memory of the pixel and drives the light-emitting device in a second state subsequent to the counter equaling the greyscale value.

In some embodiments, during a frame, for each bit of the greyscale data stored in each pixel, the light-emitting device driver of the pixel drives the light-emitting device of the pixel in one of an on-state and an off-state corresponding to a value of the bit for a time period corresponding to a weight of the bit, the light-emitting device driver driving the light emitting-device in accordance with time division clock signals.

In some embodiments, each pixel comprises a light-emitting device and a light-emitting device driver, wherein during a time of a frame the light-emitting device driver drives the light-emitting device at one of a plurality of driving force levels, and wherein under an operating condition of the pixel at least one of the driving force levels is utilized to drive the light-emitting device for a total time determined by the data in the digital memory of the pixel.

In some embodiments, the digital memory is operative for storing data comprising first greyscale data and second greyscale data, wherein the controller is operative to allow storage of incoming data comprising incoming first greyscale data simultaneously with the pixel's displaying of the second greyscale data.

In some embodiments, each pixel comprises an enable digital memory for storing a value determining one of the first mode of operation or the second mode of operation for the pixel.

In some embodiments, each greyscale bit of the incoming data are loaded into the digital memory of pixels in a row and displayed prior to a loading of a next greyscale bit.

In some embodiments, the shift register of each pixel comprises a rotating shift register.

In some embodiments, the light-emitting device driver drives the light-emitting device at a driving force based upon at least one of a peak brightness condition, a weight of a bit of the greyscale data being displayed, and a group of bits of the greyscale data.

In some embodiments, the light-emitting device driver drives the light-emitting device with use of at least one of a plurality of bias voltages and a plurality of current sources.

In some embodiments, the light-emitting device driver comprises a multiplexer with weighted select line timing for programming and retrieving data from the digital memory which comprises latches.

In some embodiments, each pixel is capable of a high dynamic range mode for which the pixel may be driven at one of a plurality of different biasing points in accordance with one of a plurality of biasing conditions for that pixel.

In some embodiments, the counter is non-linear in accordance with a gamma curve.

In some embodiments, each pixel is capable of a further test mode of operation and comprises a test circuit to control driving of the light-emitting device, wherein when the pixel is in test mode the test circuit drives the light-emitting device independent of the digital memory.

In some embodiments, each pixel is capable of a low power mode for which the greyscale data for display by the pixel constitutes a subportion of a total greyscale data stored in the digital memory.

In some embodiments, the weight of each bit of the greyscale data is assigned dynamically.

In some embodiments, the time division clock is passed from an originating pixel row to a receiving pixel row including a delay to synchronize the time division clock received by the receiving pixel row with an end of programming of the receiving pixel row.

In some embodiments, each weight of each greyscale bit corresponds to the bit order i of the greyscale bit, and the time period corresponding to a bit of weight i is proportional to $2^i$.

According to a second aspect there is provided a method of driving a display, the method comprising: determining for each pixel of a plurality of pixels of the display, each pixel comprising a digital memory and a controller, a current mode of operation being one of at least a first mode of operation and a second mode of operation; storing with use of the controller, incoming data comprising grey scale data in the digital memory, when the current mode of operation is determined to be the first mode of operation; and preserving greyscale data in the digital memory, when the current mode of operation is determined to be the second mode of operation.

The foregoing and additional aspects and embodiments of the present disclosure will be apparent to those of ordinary skill in the art in view of the detailed description of various embodiments and/or aspects, which is made with reference to the drawings, a brief description of which is provided next.

BRIEF DESCRIPTION OF THE DRAWINGS

The foregoing and other advantages of the invention will become apparent upon reading the following detailed description and upon reference to the drawings.

Figure 1:
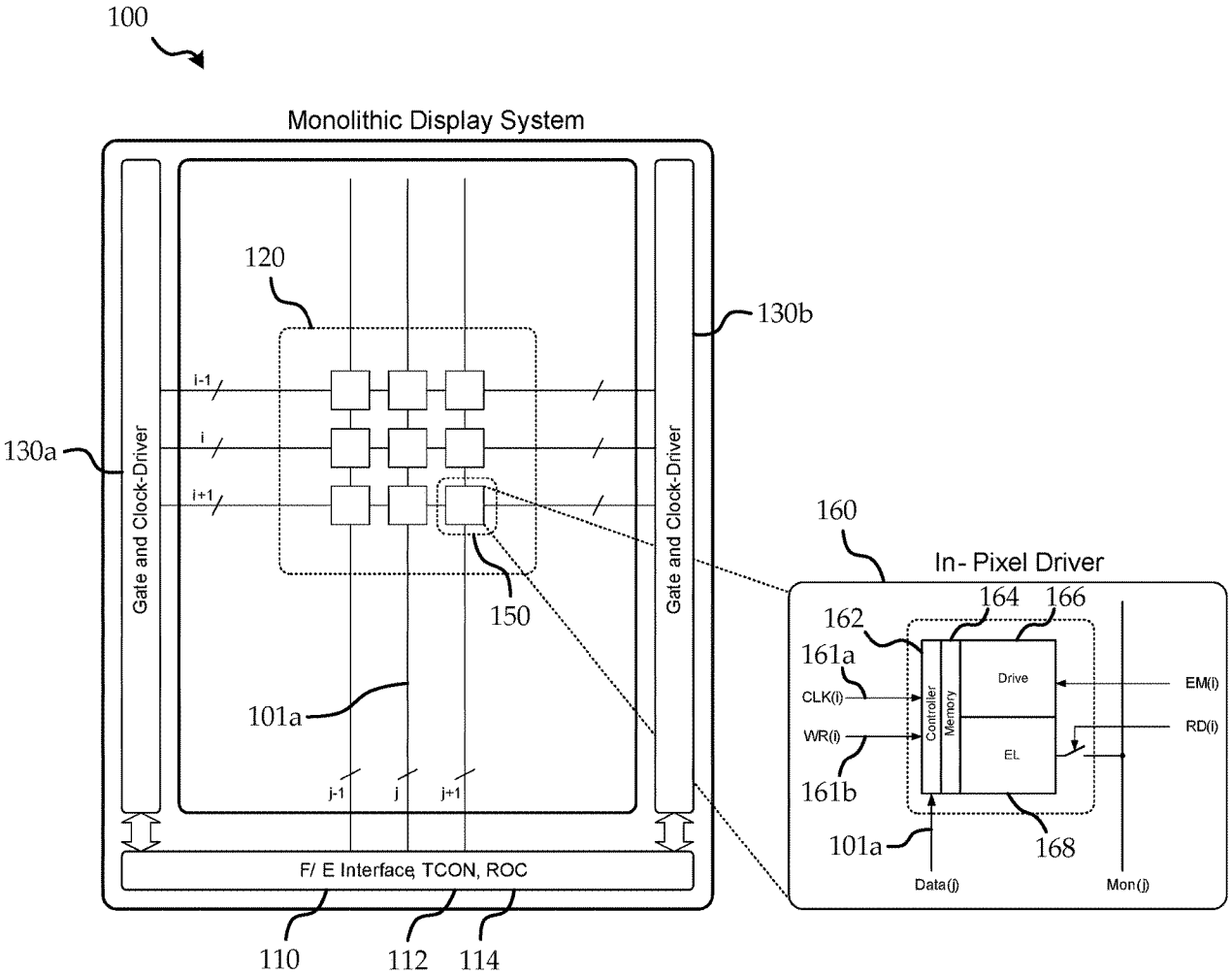
FIG. 1 is a diagrammatic illustration of a monolithic display system architecture.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

Smart-Pixel Display Architecture

A display system 100 with monolithic architecture is illustrated in FIG. 1. This architecture is constructed of a front-end interface 110, Gate and Clock-Drivers 130*a*, 130*b*, and in-pixel driving elements 160.

The front-end (F/E) interface 110 can include a timing controller (TCON) 112 and readout circuitry (ROC) 114 and/or a data driver. The front-end 110 further networks with an array 120 of in-pixel driver 160 elements and gate/clock-drivers 130*a*, 130*b*. The gate/clock-drivers 130*a*, 130*b* provide control and clock signals to rows of pixel 150 elements. Each in-pixel driver 160 element is composed of a controller 162, memory 164, current/voltage driver 166, and a light-emitting device (EL) 168.

The controller 162 within each pixel element 150 supervises the flow of data in the memory 164 devices based on the command signals on the WR (write) 161*b* and CLK (clock) 161*a* lines.

All the loading operations explained herein can be applied to other structures in this document, and also other possible structures not explained in this document. In addition, one can take features of one method and mix it with other methods. The examples here are for demonstration and are not exhaustive of all possible cases.

Figure 2:
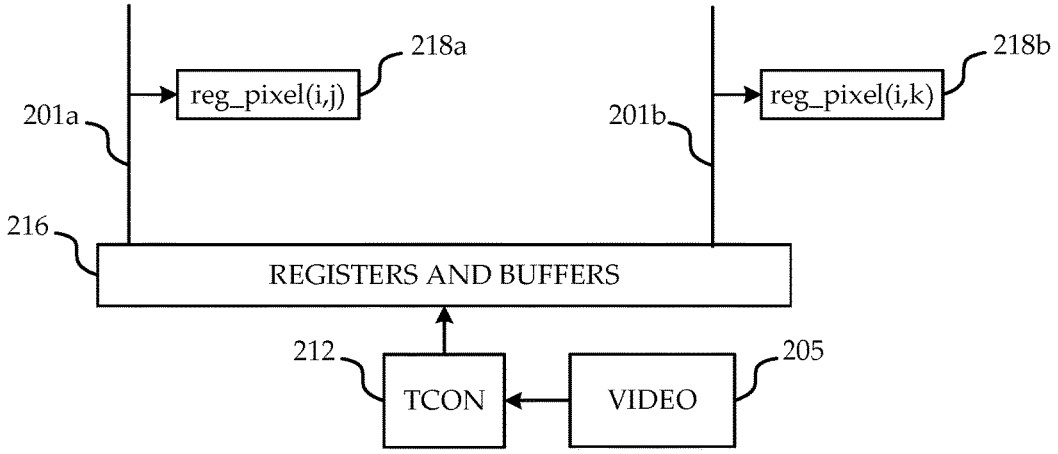
FIG. 2 is a schematic diagram of a first example of a data path between a video interface and pixel memory.

Referring now also to FIG. 2, in one aspect of the invention, the data received from the video interface 205 is stored in registers 216, connected to the columns lines 201*a*, 201*b*. Then the data is loaded from these registers 216 into the pixels in parallel or serially. In FIG. 2, the column lines 201*a*, 201*b* can be multi-bit to transfer more data during each clock.

In another aspect of the invention, the data is stored in said registers 216 partially and then the partially loaded data is transferred to the pixel in parallel or serially. In this case, the registers 216 at the boundary of the display will have fewer bits compared to the total amount of row data. In one example, if the registers 216 only store one bit for each pixel and if the row has 240×3 pixels, the total bits for the boundary registers would be 720 instead of 720×data_width (where data_width is the number of bits for gray scales, e.g. 8 bits). Here, the first bit of each pixel is loaded into the boundary registers 216, and thereafter the data is transferred to the respective pixel memory (reg_pixel) 218*a*, 218*b*. This operation continues until all of the data is loaded into the pixels of the row, and then is repeated for the next row. The operation can load the first bit of the data for the entire row (or column or entire display) and then move to the next bit. In this case, the display (or row) can be turned on after each bit and then the next bit can be loaded the display turned on for the time associated with that bit and then the process can be repeated for subsequent bits. The ON time of the pixel will be defined based on the weight of each bit loaded into the row (or display).

Figure 3:
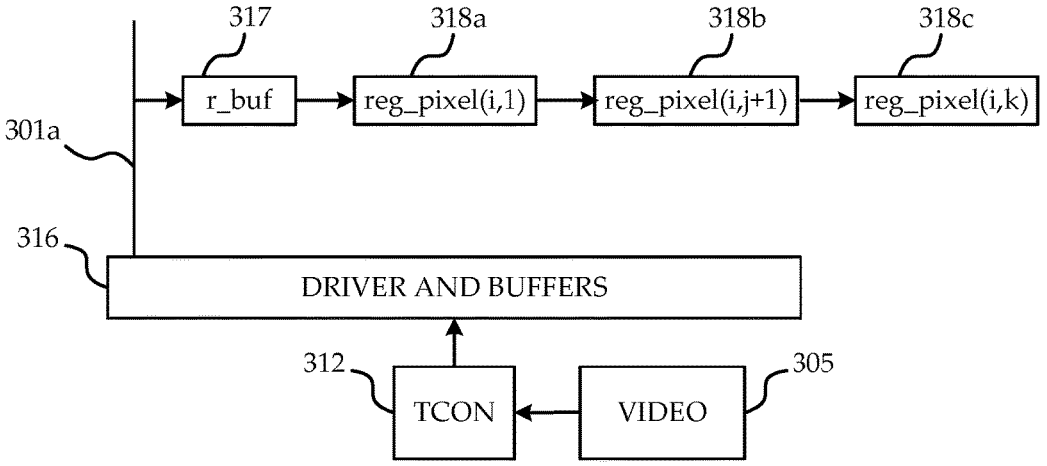
FIG. 3 is a schematic diagram of a second example of a data path between a video interface and pixel memory.

In another aspect of the invention, the data is directly loaded into the pixel memory from the video interface (FIG. 3). Here, the pixel memories 318*a*, . . . 318*c* in a row form one or more shift register chains during the programming time, and the data from the interface 205 is loaded into the shift registers without the need for serial to parallel processing.

Here, the register buffer r_buf 317 can include a switch that disconnects the data line 301*a* form the rows that are not selected for programming. Also, the register buffer 317 can have some conversion functionality such as converting low voltage differential signals to normal swing signals. Also, the driver and buffer 316 can do part or all of the conversion and so the register buffer block 317 does the remaining part.

In order to avoid reprogramming the pixels 150 during each frame if their data are not different from previously programmed data, a controller 162 is included in each pixel. Here an independent signal through this controller 162 can enable or disable pixel programming. In one example, to reduce the number of the signals, the data can begin with some value that tells the controller to enable or disable the programming. For example, the first bit can identify the programming mode of the pixel 150, for example reprogramming mode or halt mode. If the pixel is in reprogramming mode, the data will be saved in the shift register. If the pixel is in halt mode (i.e. retaining its previous data), the data in the shift register is not updated. As a result, the data for that pixel can stay as it is and so no refreshing power consumption will be associated with that pixel circuit while it is in halt mode.

In a case where the data is loaded through the row shift register, the data can be first loaded to the controller 162 to define the operation of each pixel and then the data is loaded to the shift register chain formed by pixel memories 164. If a pixel does not need to be reprogrammed, the controller 162 can bypass it in the shift register chain, passing the data on to the next pixel's shift register. In such a case the data passed along the chain will only contain that for pixels which are to be reprogrammed, the pixel data associated with pixels not being updated having been removed for example by TCON 112.

The drive element 166 in the pixel can be a fixed current/voltage or it can be changed depending on the display operation conditions and/or depending on the weight of the bit applied to the pixel. One example of a display operation is peak brightness. In this case, if the pixel brightness increases, the driving force of the pixel can increase to accommodate the peak brightness without losing digital grey levels. In another case, the driving force of the pixel is adjusted based on the weight of the bit applied to it. In another case, the pixel driving force is adjusted based on a group of the bits.

In one example, the pixel operation condition changes to adjust the drive force. For example, the bias condition of the driver 166 can be adjusted to either apply higher voltage or higher current to the emissive device 168 when needed. In another case, multiple drivers 166 with different strength exist in the pixel. Each of these driver elements 166 is controlled by different bits of grayscales or they are controlled by global signals based on display performance requirements.

In-Pixel Driving Element (Pixel Driver)

The in-pixel driving element 166 (pixel driver) can be either a voltage based driver or a current based driver. In case of a voltage driver, a simple switch can connect the voltage to the emissive device (light-emitting device). This can be one switch connected to a controllable/fixed voltage bias or multiple switches connected to multiple bias voltages.

In another example, the pixel driver 166 is a current driver. Here, the gray scale bits control the strength of the current output of the pixel driver 166; or control the connection of the pixel driver 166 to the emissive device 168; or it enables/disables the current driver 166. In another example, one can mix the three operational modes to take advantage of best characteristics of each of them.

Figure 4:
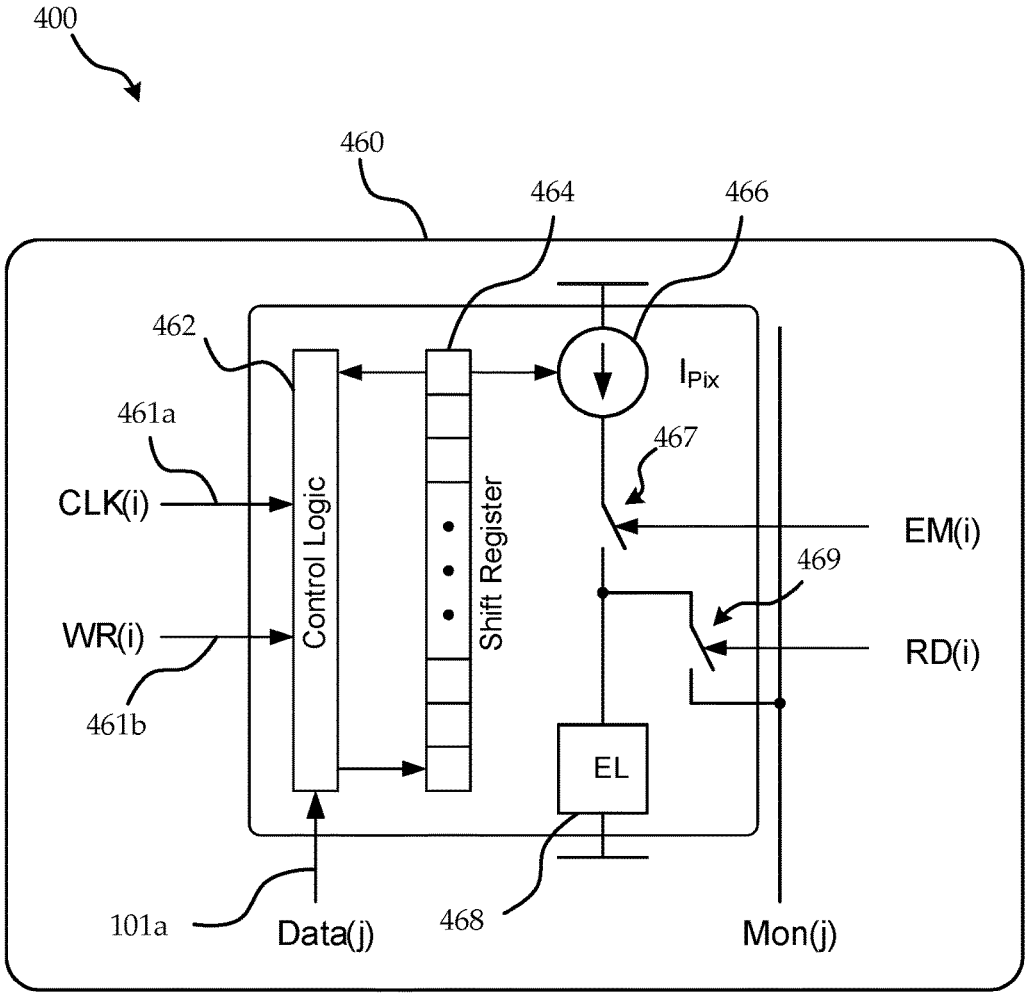
FIG. 4 is a diagrammatic illustration of an in-pixel driving element.

An example implementation of in-pixel driving is illustrated in FIG. 4. A programmable current source 466 ($I_{Pix}$) provides the driving current for the light-emitting device 468 (EL).

An EM (emission) switch 467 can be used to disconnect the pixel driver from the emissive device 468. Also, a switchable RD (read) signal path 469 provides a signal path to steer the pixel current/charge towards the ROC 114. This signal can be shared with other signals in the pixel, or the controller 462 can control this signal based on the operation mode of the pixel and status of other signals.

In case the grey scale signal is defined by the strength of the output current, the grayscale bits stored in the shift register 464 selects different strengths for the output current. In this case, the current source 466 has different elements with different output current strengths, and different combinations of these current levels are applied to the emissive device 468 according to the data stored in the shift register 464. Similar methods can be applied to a voltage-based driver 166.

In another case, the current source 466 has a fixed output. In this case, the gray scales are defined based on the time the pixel is ON which is controlled by the data stored in the shift register 464. In one case, the data stored in shift register 464 is compared with a counter value. When the two values are the same the pixel current is off (or the current source is disconnected from the emissive device; or its current is redirected to another route). It is worth mentioning that one can do the reverse of the aforementioned operations without affecting the pixel performance. In one example, with an appropriate data and counter, when the data in the shift register of the pixel is the same as the counter value, the pixel turns ON instead of turning OFF. Here the counter can be non-linear to accommodate the non-linear gamma curves. For example, it counts faster at lower grayscales and slows down as greyscale value increases. The speed of the counter can be function of the gamma curve. In another case, the output of shift register 464 is connected to the pixel driver 466 (this signal can either enable/disable the current source, or connect/disconnect the current source from the emissive device). Every clock shifts the value of the shift-register 464. As a result, depending on the value of every bit in the shift register, the pixel driver status can be different. The period of the clocks can be different based on the weight of its corresponding bits in the gamma curve. The shift register can also be a rotating shift register. In this case, the bit that is shifted out is shifted back to the pixel from the other side. As a result, the value programmed in the shift register is preserved and so panel refresh can be stopped without losing the content. This can save power consumption associated with display programming for each frame.

In all inventions and examples in this document no matter what type of signals are used for demonstrations, the clocks and signals can be either active high or active low. Also they can be at active value during the entire active period or just initiate a transition edge (edge active). In this case, they can be active at negative or positive edge or both edges.

In addition, one can use a dynamic weight for each bit so that the errors associated with time modulation effects are reduced. For example, in one case, bit0 can have the lowest value and so the last clock will have the period of time associated with that during the frame time. In another case, bit3 can have the lowest value and so the third clock from the last will have the time associated with the lowest bit during the frame time.

In another aspect of this invention, one can use combination of different signal strengths and timing conditions. One example of this case is to have a few output strengths for each pixel. Depending on the condition of the pixel, one of these outputs is used for time modulation. For example, a global signal can identify high brightness mode, and so the highest output strength is used for time modulation driving.

In the case of using a shift register 464 in the pixel for creating a time modulation effect, the time division clock can be passed to each row through a clock shift register at the edge of the panel, with the clock shift register having a similar size as the number of rows or greater. The clock pattern that has the weight of each bit is shifted into the clock shift register after each shift register clock (this clock can be similar to the clock used for creating the select line for each row, which has a period equal to or smaller than the row time). In another example, the clock can be a separate clock. In this case, one can create different time modulation without being limited to the clock period.

Figure 5:
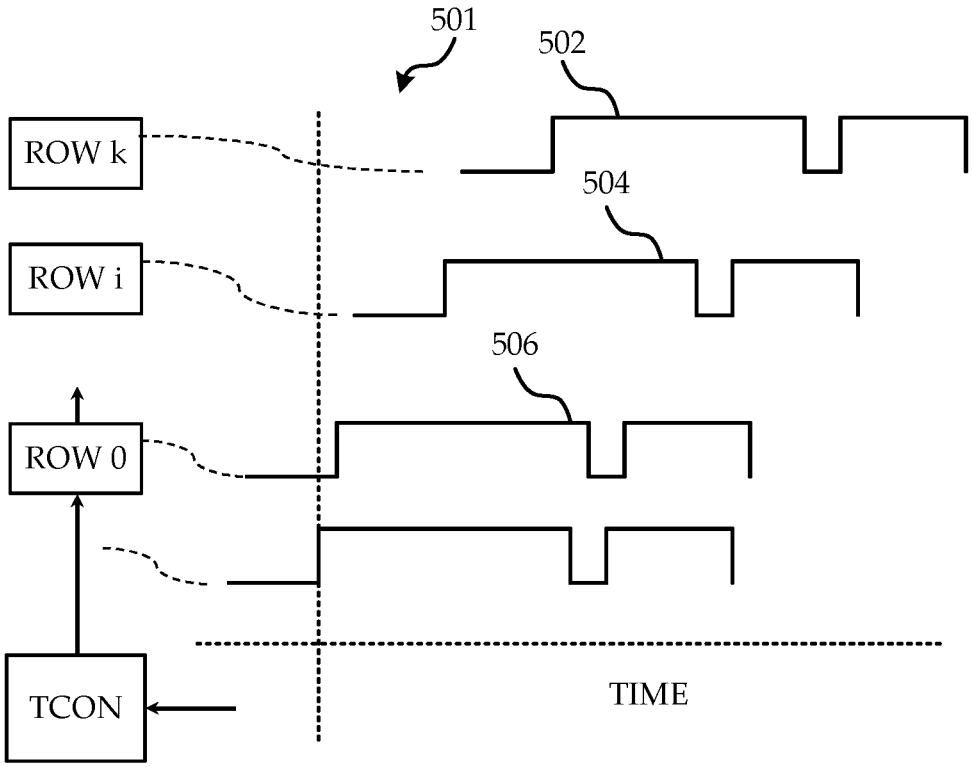
FIG. 5 is a timing diagram of one example of distributing a time division clock among rows.

FIG. 5 illustrates one example of this operation. Here, the time-modulation clock is generated with a timing controller or passed by an external circuit to the display. The first part of the clock 501 is not active, which is associated with the pixel programming time. After the row programming is finished, the row can be activated (here the clock is active high but it can be active low as well). Then the clock toggles so that it shifts the value in the pixel shift registers one bit forward. Then it stays active for another period of time. The same situation follows for the next row and the row after. Here, one may need to use multiple shift registers and logic to create different time divisions especially if the number of rows and the number of grayscales do not match.

Figure 6:
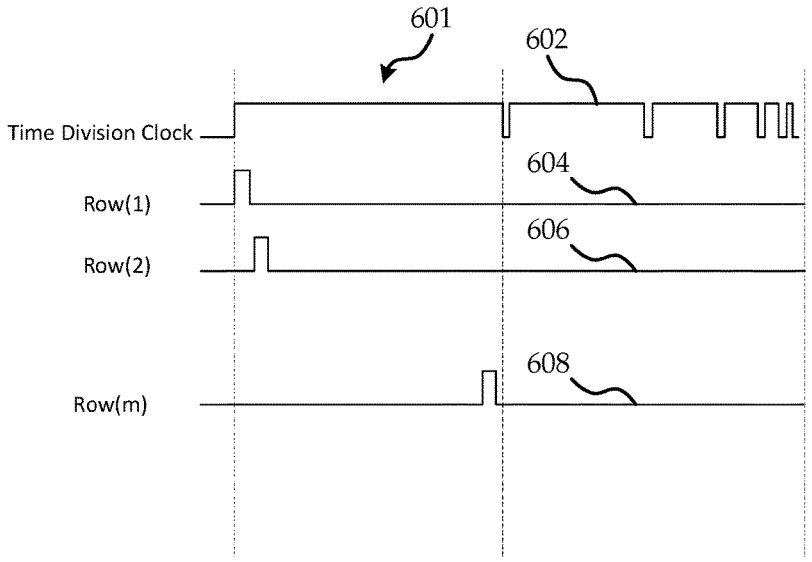
FIG. 6 is a timing diagram of another example of distributing a time division clock among rows, using faster programming.

FIG. 6 illustrates another example of the invention. Here, the programming 604, 606, 608 happens during the longer period 601 of the time division clock 602. In one aspect of the invention, the clock for each row can be buffered or another form of buffering can be used. In another aspect of the invention, the clock buffered for each row can be masked by the programming signal of that row so that during the programing of that row the row is not emitting any output.

Figure 7:
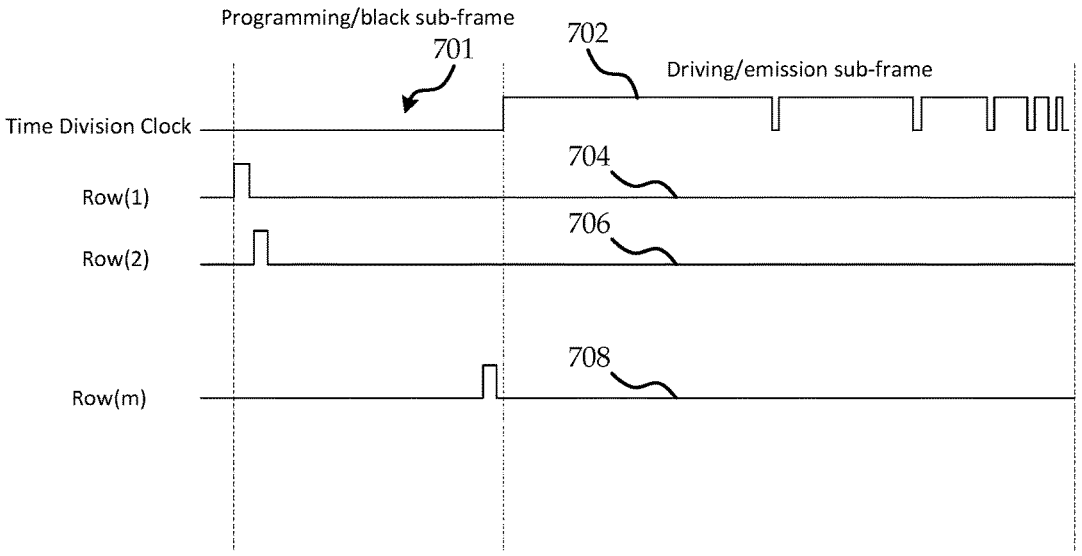
FIG. 7 is a timing diagram of a further example of distributing a time division clock among rows, using black sub-frames for programming.

FIG. 7 illustrates another example of the invention utilizing a time division clock 702. Here, the programming 704, 706, 708 happens during a black sub-frame period 701 where the panel is not emitting any image. In one aspect of the invention, the clock can be buffered for each row or another form of buffering can be used.

Figure 8:
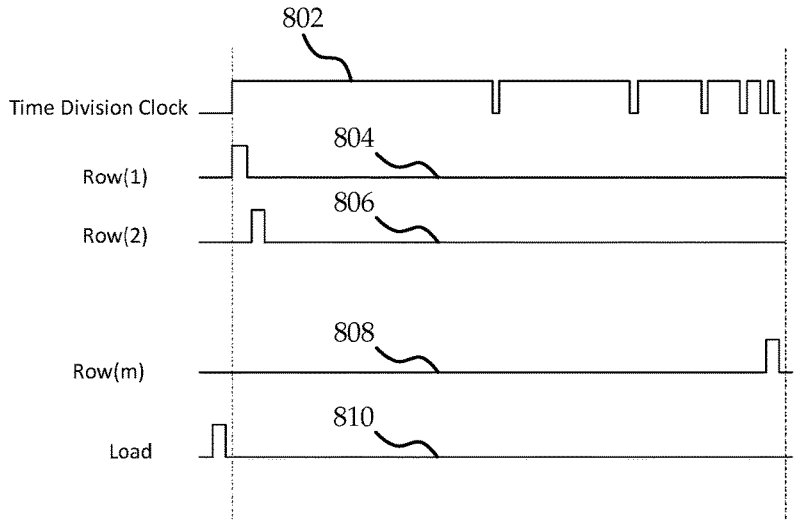
FIG. 8 is a timing diagram of a yet another example of distributing a time division clock among rows, using double storage elements in the pixels.

FIG. 8 illustrates another example of the invention utilizing a time division clock 802. Here, the programming 804, 806, 808, 810 happens during normal operation of normal frame. However, the pixels have two data storage elements. While one is being programmed, the other element is used for programming. After the programming, one can either swap the functions of the two storage elements or load the value saved in the programming storage element into the driving storage element. In one aspect of the invention, the clock for each row can be buffered, or another form of buffering can be used. In this case, the entire programming storage element of the panel can be configured as one shift register and so the data for all the pixels can be shifted into it.

Pixel-Based Addressing

Figure 9A:
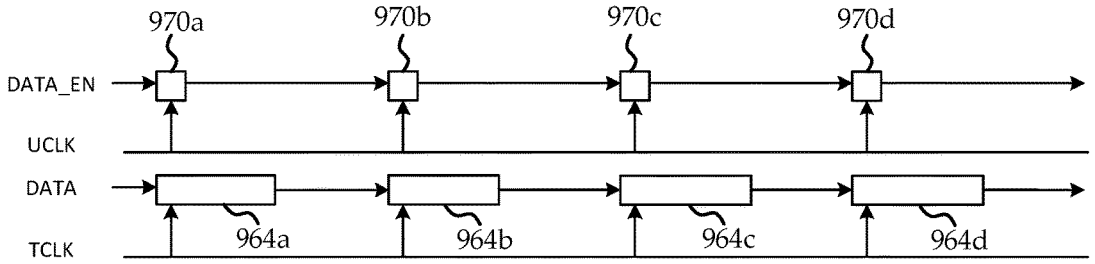
FIG. 9A is a block diagram of storage elements for enable signals for multiple pixels.
Figure 9B:
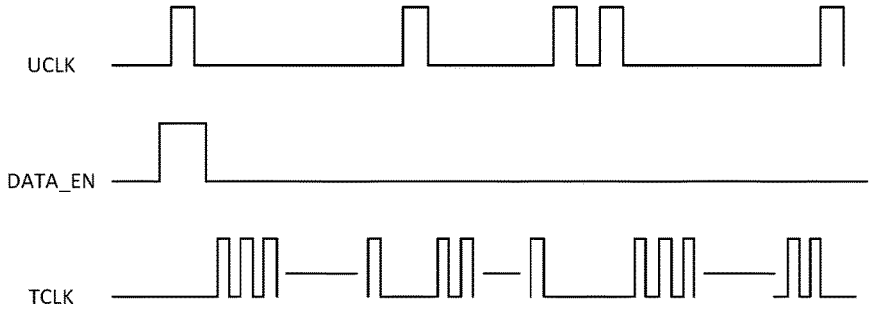
FIG. 9B is a timing diagram of pixel-based addressing based on storage elements for enable signals.

Here, the data of a pixel 150 (or part of its data) can be preserved or alternatively changed. In this case, a signal determines if the content of the data needs to be adjusted or not. This signal can be stored in the storage element 970 for each pixel (or part of pixel) or it can be passed to the pixel by a column path routing. The storage elements 970*a*, . . . , 970*d*, for enable signal is demonstrated in FIGS. 9A and 9B.

When using a storage element 970*a*, . . . , 970*d*, the enable data can be stored in the pixel in advance or it can be passed along with the data programming. If the data is shifted to the row registers, using a parallel updating of the enable bit can significantly reduce the toggle rate in the programming. Assuming that the enable signal is active high, the data enable is initialized with zero (only once at the beginning of the panel power on). Then, a one is passed to the data enable register 970*a*, . . . , 970*d*. It is shifted to the pixel whose data needs to be programmed, and the data of the pixel is changed (only the bits that need to be changed are modified). And this is repeated by shifting the one in the data enable to the next pixel in the row that needs its data to be updated.

In-Pixel Driving Scheme

Figure 10:
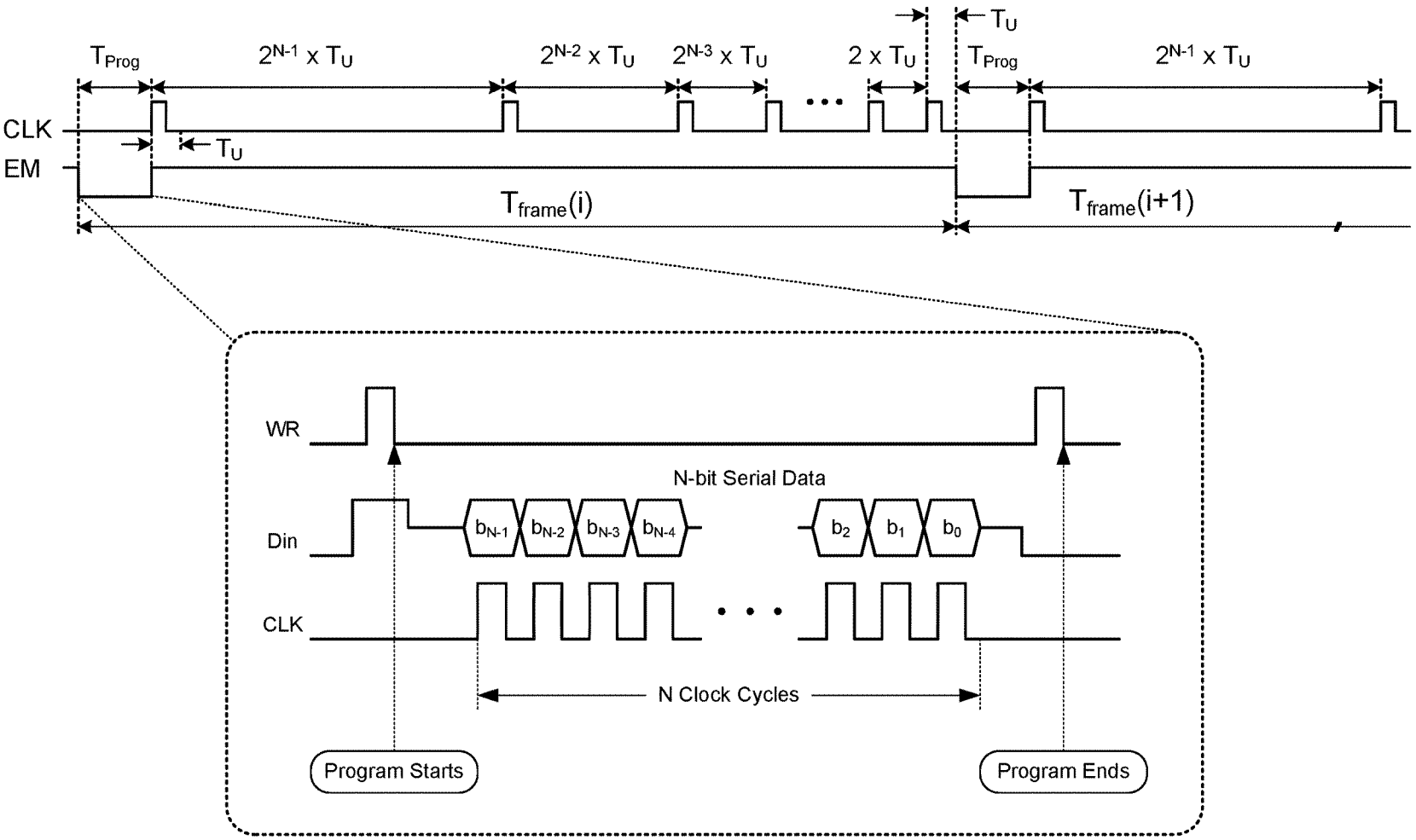
FIG. 10 is a timing diagram for an exemplary driving scheme for in-pixel drivers.

An example of driving scheme is sketched in FIG. 10. In this scheme, the drive current representing the desired output luminance grayscale is quantized by an N-bit digital signal. The N-bit data is programmed and stored in the shift register of FIG. 4. Each bit of the N-bit data ($b_{N-1}b_{N-2} \ldots b_1b_0$) modulates the fixed drive current ($I_{Pix}$) in a window of time, which is proportional to $2^i \times T_u$ where i is the bit order (0 to N−1) and $T_u$ is the unit time window. Accordingly, the effective EL drive current in each frame time is given by:

$$I_{eff} = I_{Pix}\frac{T_u}{T_{Frame}}\sum_{i=0}^{N-1} b_i 2^i \tag{1}$$

Note that:

$$T_u = \frac{T_{Frame} - T_{prog}}{2^N} \tag{2}$$

and hence replacing (2) in (1) results in:

$$I_{eff} = \alpha\frac{I_{Pix}}{2^N}\sum_{i=0}^{N-1} b_i 2^i \tag{3}$$

where α is a constant given by:

$$\alpha = \frac{T_{Frame} - T_{prog}}{T_{Frame}} \tag{4}$$

During the program time, the driving current is momentarily deactivated by the EM signal. A logic "1" is asserted on the data line and stored in the controller by a clock pulse on the WR in preparation of a program sequence. An N-bit serial data is then clocked in and programmed in the shift register. Finally, a logic "0" is asserted on the data line and stored in the controller by a clock pulse on the WR in order to halt the program mode.

The described sequence along with the proposed in-pixel driving element provides a unique feature, which enables programming of individual pixels in the selected row. This is particularly useful for power saving when only parts of an image are required to be updated in a given frame.

Multiplexer-Based Pixel

Figure 11:
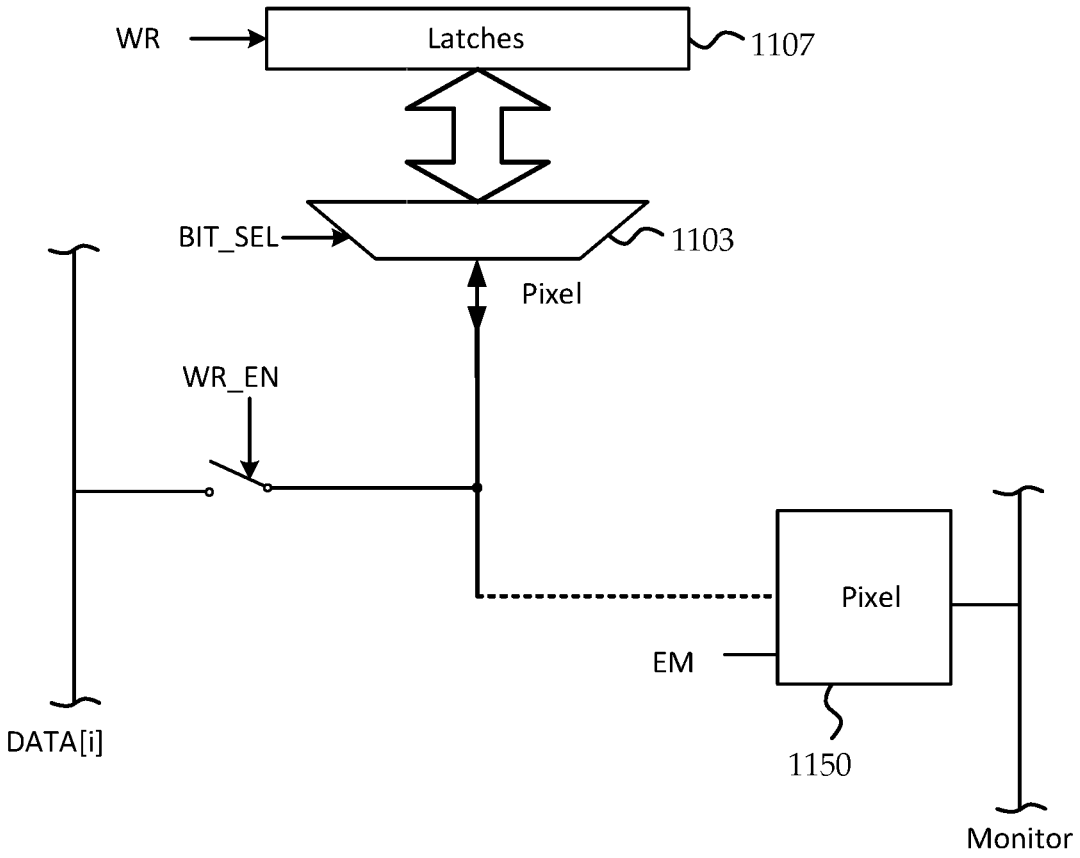
FIG. 11 is a schematic diagram of a mux-based pixel circuit.

Depending on the content, the toggle for each pixel 1150 can be significant. To reduce the toggle rate in the shift registers, one can use a multiplexer 1103 with weighted select line (BIT_SEL) timing, as illustrated in FIG. 11. Here, the programming can happen during shifting the data or one can use the same multiplexer to program the pixel as well. In this case, the storage element can be replaced with simple latches 1107 to reduce the overhead.

Testing Mode

Figure 12:
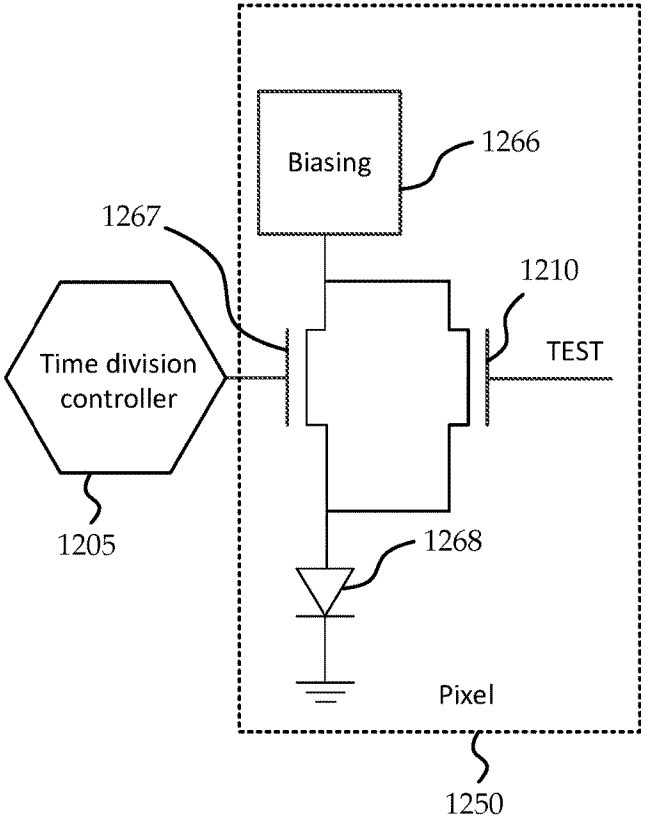
FIG. 12 is a schematic diagram of a testing display.

The main challenge with integrated pixel circuit is the initial test of the panel. In FIG. 12, an extra switch 1210 is used to connect the bias section 1266 of the pixel circuit 1250 to the emissive device 1268 during a test mode. Also, the other switch 1267 is connected to a time division controller 1205 that can be implemented by a shift register, multiplexer, counter (or other components), as discussed above.

Figure 13:
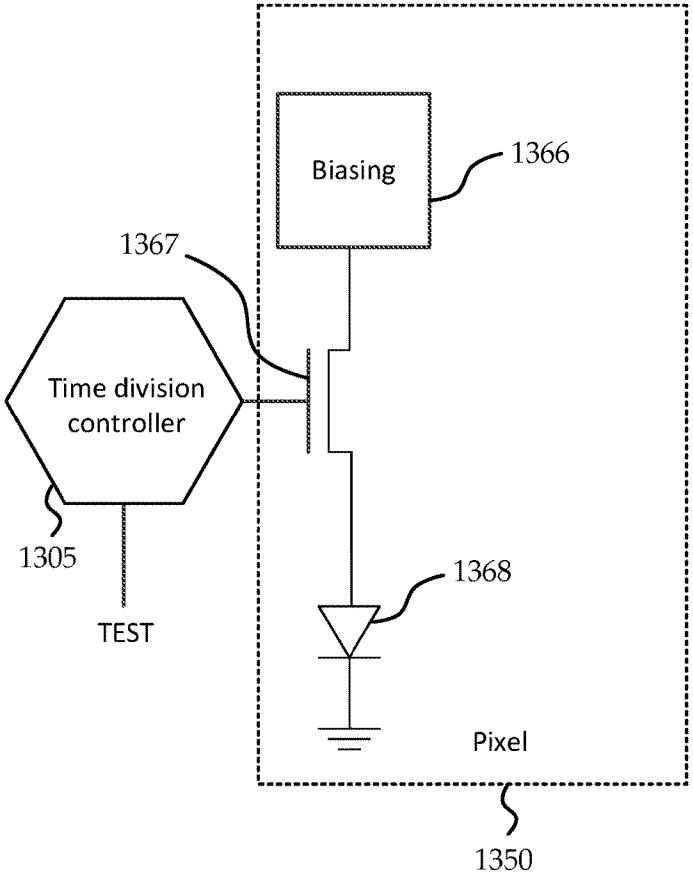
FIG. 13 is a schematic diagram of a display test using a time division controller to connect a pixel in a test mode.

FIG. 13 illustrates a display test using a time-division controller 131 to connect the pixel in a test mode. The time-division controller 131 connects the biasing circuit 132 to the emissive device 132 through a switch 133 in a special test mode. This test mode can be activated by a specific signal instruction, or by a combination of signals.

Low Power Mode

In a low-power mode, the number of gray scales is reduced. For programming, either some of the data copied in the pixel shift registers remains unused, or part of the shift registers is removed from the chain so that only the required bits are active. At the same time the number of clock cycles associated with a time division clock can be reduced, although this is not required for functionality of the display. It will only save power consumption. If a counter is used for creating time modulation, the counter size is reduced as well to match the new number of gray scales.

High Dynamic Range Modes

In a high dynamic range (HDR), the pixels need to provide significantly higher brightness and very dark levels. The main challenge is that the emissive device performance gets compromised if one bias condition is used for the entire operation range of the pixel. For example, if the emissive devices are biased at a high current level and the brightness is controlled with only a time division function, the color of the display may get scarified since the emissive device loses color purity at higher current density. To avoid this, the pixel can offer different biasing points for the emissive device and, depending on the operation range of the pixel, one can select the biasing condition as well. The selection can be globally or for each pixel by programming the biasing condition into the pixel. The programming can be by at least one of analog voltage and digital data.

In one aspect of this invention, there can be different operation points for the pixel circuits that can provide different biasing levels for the emissive devices. In another aspect of the invention, different circuits can be selected for different biasing levels for the emissive devices. Also, one can use a mix of the two cases.

The invention in these documents can be combined together selectively in entirety or partially as needed for an application. The features described for one invention in the document can be applied to the other inventions as well without affecting the performance of the system. The position and orientation of emissive device can be easily changed without affecting the general operation of the pixel circuit. Type of the switches and the transistors can be either p-type, n-type or T-gate without any effect on the pixel circuit.

While particular embodiments and applications of the present invention have been illustrated and described, it is to be understood that the invention is not limited to the precise construction and compositions disclosed herein and that various modifications, changes, and variations can be apparent from the foregoing descriptions without departing from the spirit and scope of the invention as defined in the appended claims.

What is claimed is:

1. A display system comprising:

a plurality of pixels each capable of at least a first mode of operation and a second mode of operation, each pixel comprising:

a light-emitting device;

a light-emitting device driver for driving the light-emitting device to emit light;

a digital memory including a shift register for storing data comprising greyscale data for display by the pixel, the shift register having an output coupled to the light-emitting device driver for controlling the driving of the light-emitting device, the greyscale data stored in the shift register shifted by a bit in response to each clock signal of a time division clock input to the pixel, the time division clock including different clock signal periods corresponding to the different weights of the bits of the greyscale data; and a controller operative to allow storage of incoming data to the digital memory in the first mode of operation and to preserve data in the digital memory in the second mode of operation.

2. The display system of claim 1, wherein the plurality of pixels are arranged into at least one row, and wherein a plurality of shift registers of pixels in the at least one row are chained together into a shift register chain, wherein incoming data loaded to the shift register chain includes only data for pixels in the first mode of operation, and wherein controllers of pixels in the second mode of operation cause the incoming data to bypass the pixels in the second mode of operation.

3. The display system of claim 1 wherein during a time of a frame the light-emitting device driver drives the light-emitting device for a total time determined by the data in the digital memory of the pixel according to the output of the shift register controlling the driving of the light-emitting device as shifted by the time division clock.

4. The display system of claim 1 wherein during a frame, for each bit of the greyscale data stored in each pixel, the light-emitting device driver of the pixel drives the light-emitting device of the pixel in one of an on-state and an off-state corresponding to a value of the bit for a time period corresponding to a weight of the bit, the light-emitting device driver driving the light emitting-device in accordance with said time division clock signals.

5. The display system of claim 1 wherein the digital memory is operative for storing data comprising first greyscale data and second greyscale data, wherein the controller is operative to allow storage of incoming data comprising incoming first greyscale data simultaneously with the pixel's displaying of the second greyscale data.

6. The display system of claim 1 wherein each pixel comprises an enable digital memory for storing a value determining one of the first mode of operation or the second mode of operation for the pixel.

7. The display system of claim 1 wherein each greyscale bit of the incoming data are loaded into the digital memory of pixels in a row and displayed prior to a loading of a next greyscale bit.

8. The display system of claim 1 wherein the shift register of each pixel comprises a rotating shift register.

9. The display system of claim 1 wherein the light-emitting device driver drives the light-emitting device at a driving force based upon at least one of a peak brightness condition, a weight of a bit of the greyscale data being displayed, and a group of bits of the greyscale data.

10. The display system of claim 1 wherein the light-emitting device driver drives the light-emitting device with use of at least one of a plurality of bias voltages and a plurality of current sources.

11. The display system of claim 1 wherein the light-emitting device driver comprises a multiplexer with weighted select line timing for programming and retrieving data from the digital memory which comprises latches.

12. The display system of claim 1 wherein each pixel is capable of a high dynamic range mode for which the pixel may be driven at one of a plurality of different biasing points in accordance with one of a plurality of biasing conditions for that pixel.

13. The display system of claim 1 wherein the different clock signal periods corresponding to the different weights of the bits of the greyscale data are non-linear in accordance with a non-linear gamma curve.

14. The display system of claim 1 wherein each pixel is capable of a further test mode of operation and comprises a test circuit to control driving of the light-emitting device, wherein when the pixel is in test mode the test circuit drives the light-emitting device independent of the digital memory.

15. The display system of claim 1 wherein each pixel is capable of a low power mode for which the greyscale data for display by the pixel constitutes a subportion of a total greyscale data stored in the digital memory.

16. The display system of claim 1 wherein the weight of each bit of the greyscale data is assigned dynamically.

17. The display system of claim 1 wherein the time division clock is passed from an originating pixel row to a receiving pixel row including a delay to synchronize the time division clock received by the receiving pixel row with an end of programming of the receiving pixel row.

18. The display system of claim 1 wherein each weight of each greyscale bit corresponds to the bit order i of the greyscale bit, and the time period corresponding to a bit of weight i is proportional to $2^i$.

* * * * *